US005387127A

United States Patent [19]

Wang

[11] Patent Number: 5,387,127

[45] Date of Patent: Feb. 7, 1995

[54] SHIELDING DEVICE FOR T-TYPE BNC CONNECTORS

[76] Inventor: Tsan-Chi Wang, 1 Fl., No. 13, Lane 312, Chung Chen Rd., Hsin Tien City, Taipei Hsien, Taiwan, Prov. of China

[21] Appl. No.: 111,788

[22] Filed: Aug. 26, 1993

[51] Int. Cl.[6] ..... H01R 13/658

[52] U.S. Cl. ..... 439/582

[58] Field of Search ..... 439/188, 578–582, 439/314, 320, 322

[56] References Cited

U.S. PATENT DOCUMENTS

| | | | |
|---|---|---|---|
| 4,892,491 | 1/1990 | Budano, II et al. | 439/582 |
| 5,083,934 | 1/1992 | Kawaguchi | 439/582 |
| 5,219,299 | 6/1993 | Wang | 439/582 |
| 5,226,838 | 7/1993 | Hsu | 439/582 |

*Primary Examiner*—Neil Abrams

*Attorney, Agent, or Firm*—Lowe, Price, LeBlanc & Becker

[57] ABSTRACT

A shielding device for protecting a T-type BNC connector against static electricity and magnetic fields, comprised of a four-way shielding tube formed by connecting two opposing halves together through a sealing process and covered around the T-shaped shell and two transversely disposed opposite BNC jacks of the T-type BNC connector, and a tubular insulative shield covered around the vertically disposed BNC plug of the T-type BNC connector, the four-way shielding tube having a blocking plate blocked on the T-shaped shell of the T-type BNC connector at the bottom and an earth terminal fastened in a hole on the blocking plate.

4 Claims, 7 Drawing Sheets

SHIELDING DEVICE FOR T-TYPE BNC CONNECTORS

BACKGROUND OF THE INVENTION

The present invention relates to shielding devices, and more particularly to a shielding device for protecting a T-type BNC connector against the interference of static electricity and magnetic fields.

Various T-type BNC connectors have been disclosed for use in computer systems, and have appeared on the market. For example, U.S. Pat. No. 5,219,299, issued to Tsan-Chi Wang, discloses a resistor coupled T-type BNC connector. This resistor coupled T-type BNC connector, as shown in FIG. 1, is coupled with a ceramic resistor to eliminate outside noises effectively. Under normal conditions, this resistor coupled T-type BNC connector is practical in use and can effectively eliminate outside noises. However, this resistor coupled T-type BNC connector can not eliminate the interference of static electricity. As the user touches the shell of the connector with the hand, static electricity will occur and affect the quality of the transmission. Sometimes, electric shocks may happen due to a potential difference.

SUMMARY OF THE INVENTION

The present invention has been accomplished to eliminate the aforesaid problems by covering a shielding device around the outside wall of the T-type BNC connector. The shielding device is made of an insulative material, for example: Acrylnitrile-Butadiene-Sterene copolymer, comprised of a four-way shielding tube and a tubular insulative shield. The tubular insulative shield covers around the vertical BNC plug of the T-type BNC connector. The four-way shielding tube is comprised of two symmetrical halves connected together through a sealing process and covered around the T-shaped shell and two horizontally disposed opposing BNC jacks of the T-type BNC connector.

DETAILED DESCRIPTION OF THE PREFERRED EMBODIMENT

Figure 1:
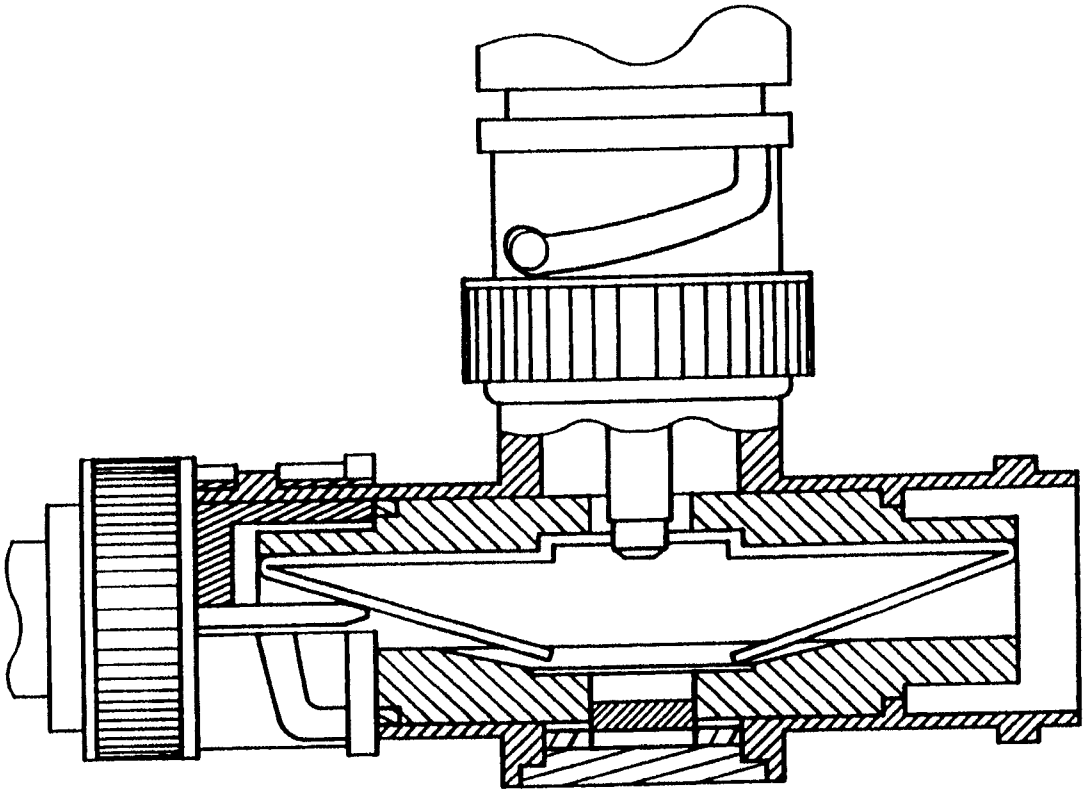
Fig. 1 PRIOR ART
FIG. 1 is a longitudinal view in section of a prior art T-type BNC connector.
Figure 2:
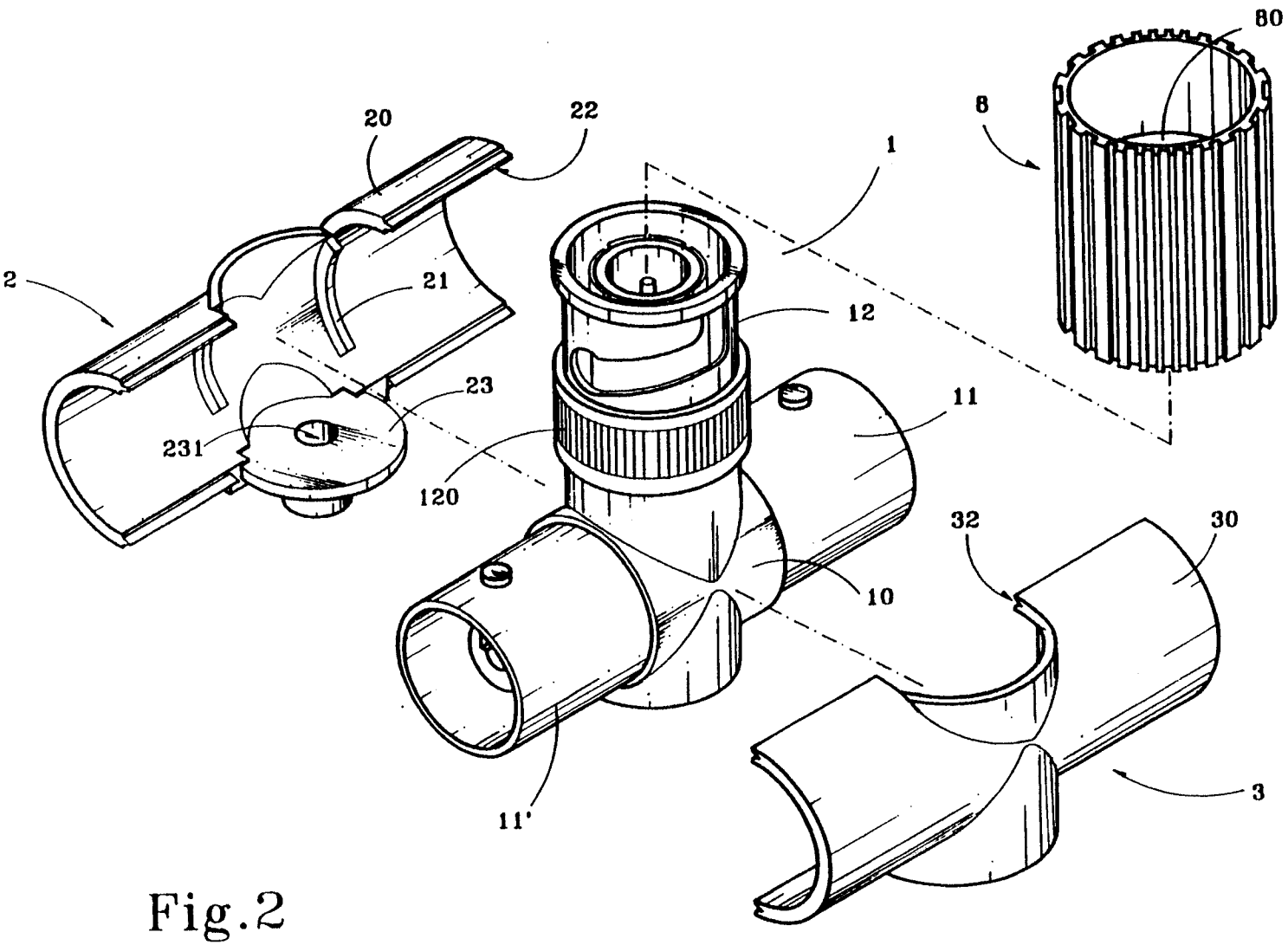
FIG. 2 is an exploded view of the shielding device of the present invention relative to the T-type BNC connector.

Referring to FIG. 2, a T-type BNC connector 1 is shown comprised of a T-shaped shell 10 having a BNC plug 12 vertically disposed in the middle at the top and two BNC jacks 11;11' transversely disposed at two opposite sides in reverse directions for connecting a respective BNC connector of a computer network system, and a shielding device covered around the T-shaped shell 10 and its BNC plug 12 and BNC jacks 11;11'.

Figure 3:
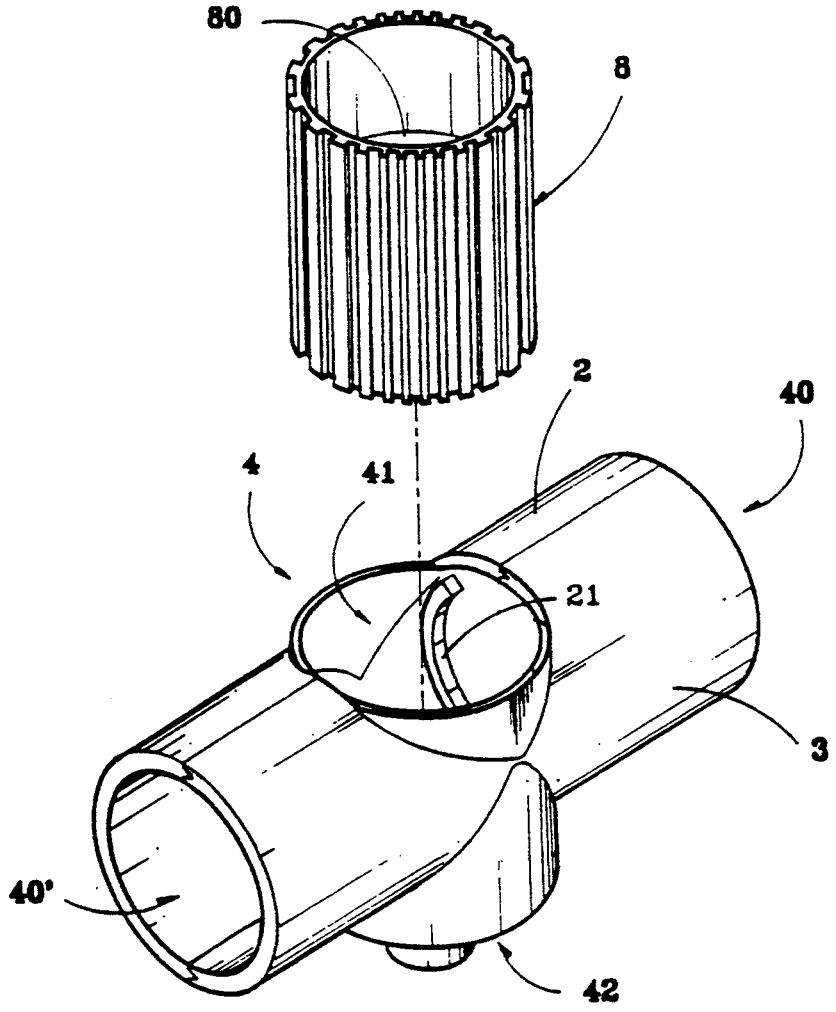
FIG. 3 is an elevational view of the shielding device of the present invention, showing the insulative tubular shield disconnected from the four-way shielding tube.
Figure 4:
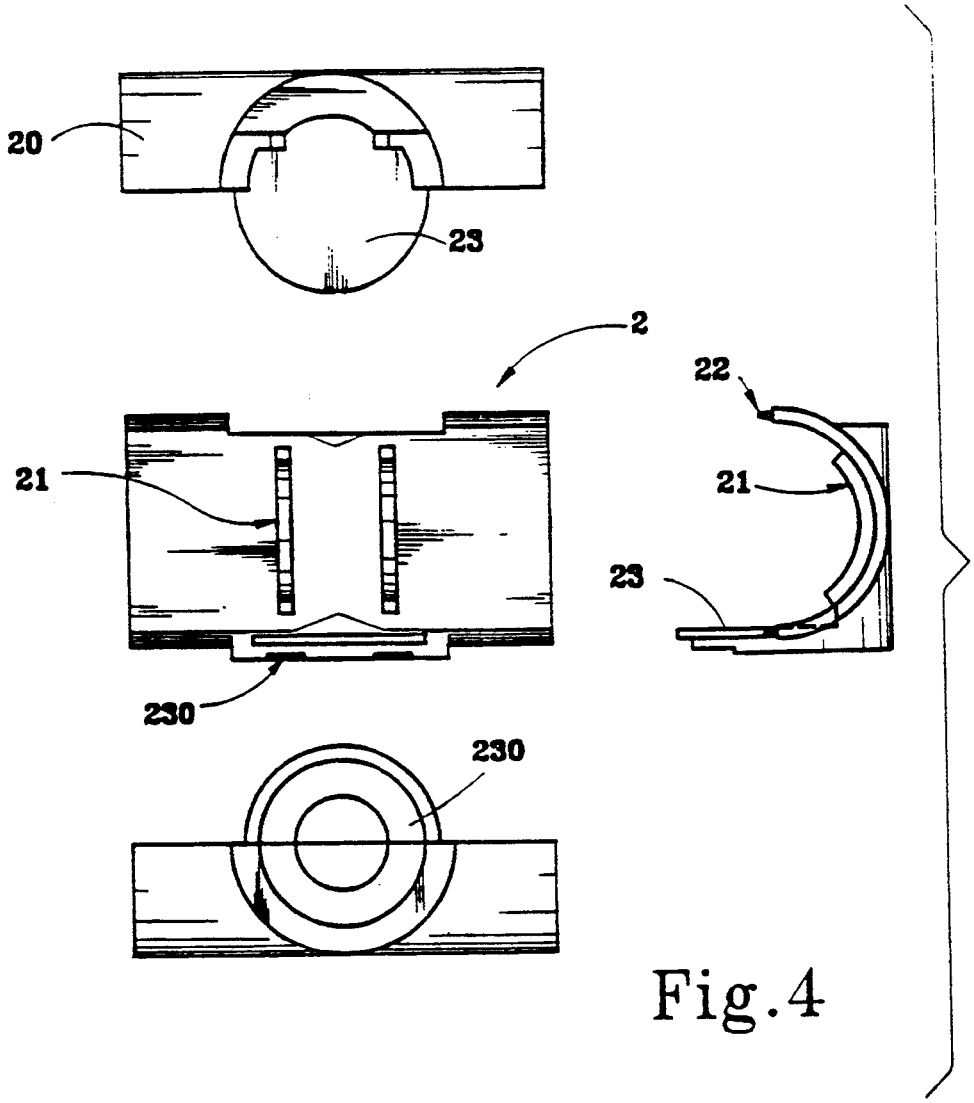
FIG. 4 is the top, bottom, and side views of the male insulative shield of the shielding device of the present invention.
Figure 5:
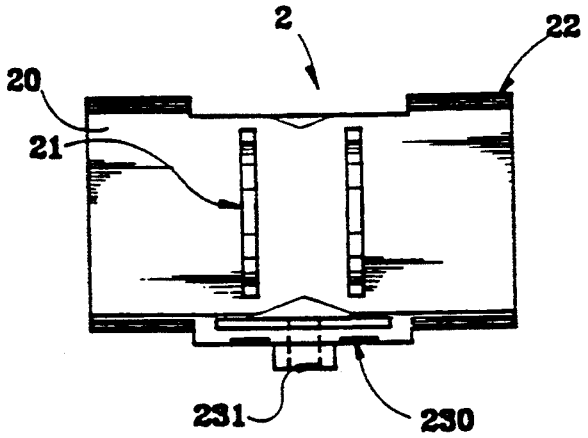
FIG. 5 is a sectional view of the male insulative shield, showing an alternate form of the center through hole on the blocking plate thereof.
Figure 6:
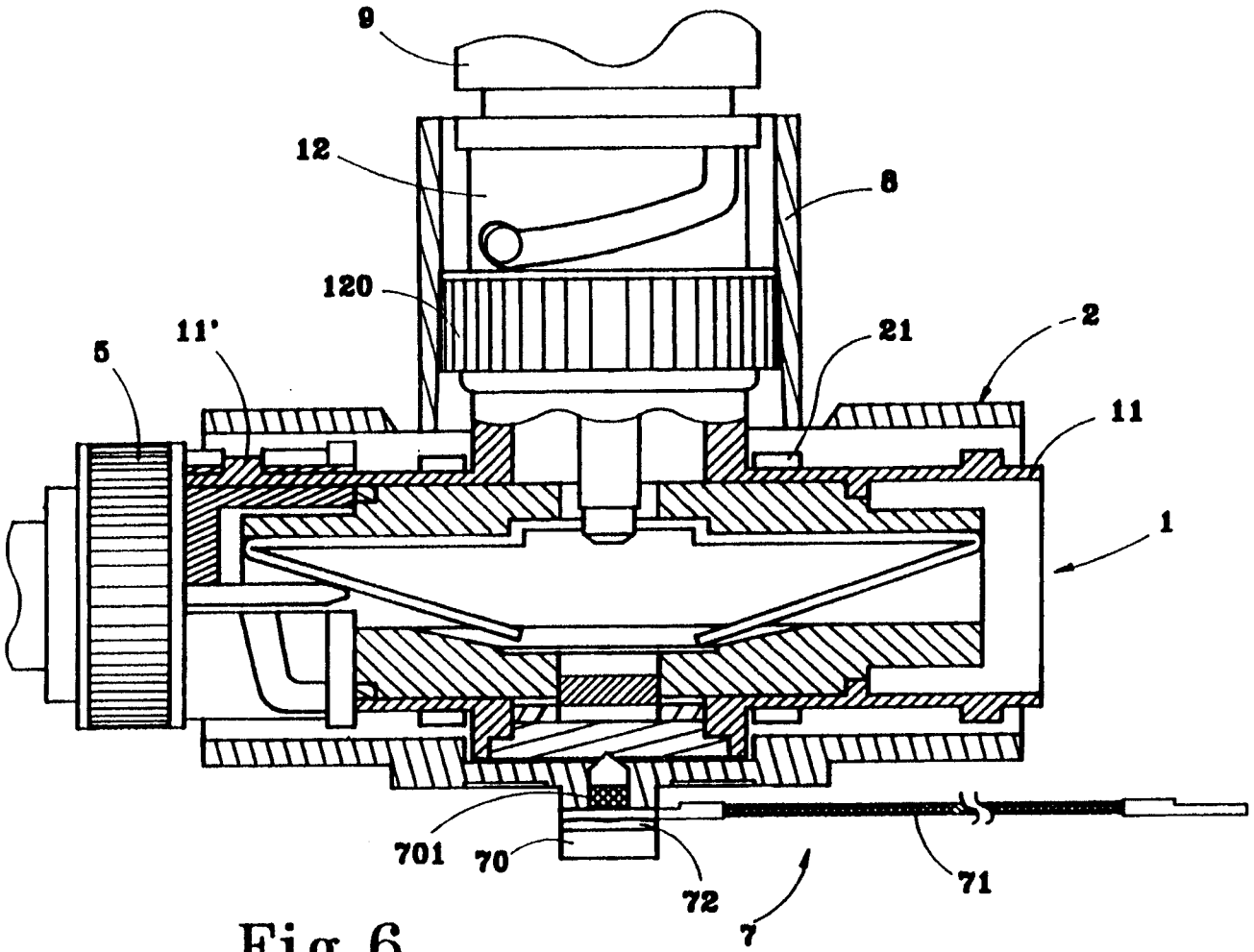
FIG. 6 is a longitudinal view in section of the shielding device installed in the T-type BNC connector.
Figure 6A:
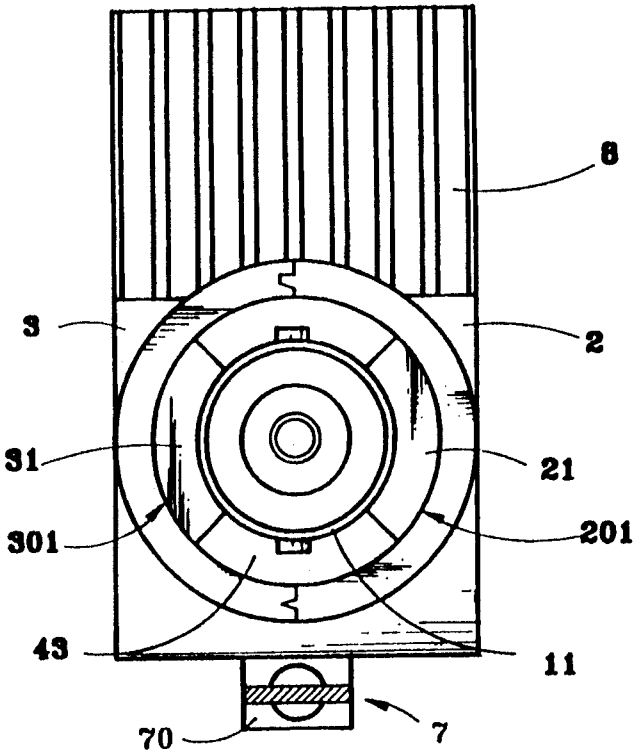
FIG. 6A is an end view in section taken on FIG. 6, showing an annular gap defined between the four-way shielding tube and the T-type BNC connector for connecting a respective external BNC connector from either side.

Referring to FIG. 3 and FIG. 2 again, the shielding device is comprised of a male insulative shield 2 and a female insulative shield 3 connected together and covered around the BNC jacks 11;11', and a tubular insulative shield 8 fastened to the male and female insulative shields 2;3 and covered around the BNC plug 12. The male and female insulative shields 2;3 are respectively made of ABS copolymer (Acrylnitrile-Butadiene-Sterene copolymer) through an injection molding process, each having an elongated shield body 20 or 30 in a half-round section. As male and female insulative shields 2;3 are connected together, the elongated shield bodies 20;30 form into a four-way shielding tube 4. The four-way shielding tube 4 comprises two transverse holes 40;40' transversely aligned in reversed directions, which receive the BNC jacks 11;11' respectively, two vertical holes, namely, the top vertical hole 41 and the bottom vertical hole 42 vertically aligned in reversed directions and respectively communicated with the transverse holes 40;40' in the middle. The BNC plug 12 projects over the top vertical hole 41 of the four-way shielding tube 4. The four-way shielding tube 4 comprises sector-like ribs 21;31 symmetrically raised from the inside walls 201;301 of the male and female insulative shields 2;3. As shown in FIG. 6A, the ribs 21;31 are symmetrically clamped on the BNC jacks 11;11', and an annular gap 43 is maintained between the inside walls 201;301 of the male and female insulative shields 2;3 and the BNC jacks 11;11'. Therefore, an external BNC connector 5 can be inserted into the annular gap 43 from either side and then electrically connected to the BNC jack 11 or 11'. Tongues 22 and grooves 32 are respectively made on the male and female insulative shields 2;3 for permitting the male and female insulative shields 2;3 to be connected together through tongue-and-groove joints. As the male and female insulative shields 2;3 are connected into the aforesaid four-way shielding tube 4 through tongue-and-groove joints, the connecting portions are sealed through an ultrasonic sealing process. Further, the male insulative shield 2 comprises a unitary blocking plate 23 extended from the elongated shield body 20 in the middle at the bottom and blocked on the bottom vertical hole 42. As illustrated in FIGS. 4 and 5, the blocking plate 23 comprises an annular groove 230 marked with the specifications of the T-type BNC connector, and a center through hole 231 through which an earth terminal 7 is inserted and connected to the four-way shielding tube 4.

The earth terminal 7 may be variously embodied. As shown in FIG. 6, the earth terminal 7 is comprised of a rivet 70, a chain 71 connected to the rivet 70, and a packing ring 72 fastened to the rivet 70. The rivet 70 has an embossed tip 701 fitted into the center through hole 231 on the blocking plate 23 and engaged into the shell 10 of the T-type BNC connector 1. The chain 71 is preferably of a tether chain, turnably retained to the rivet 70 by the packing ring 72. The opposite end of the chain 71 is connected to ground.

Figure 7:
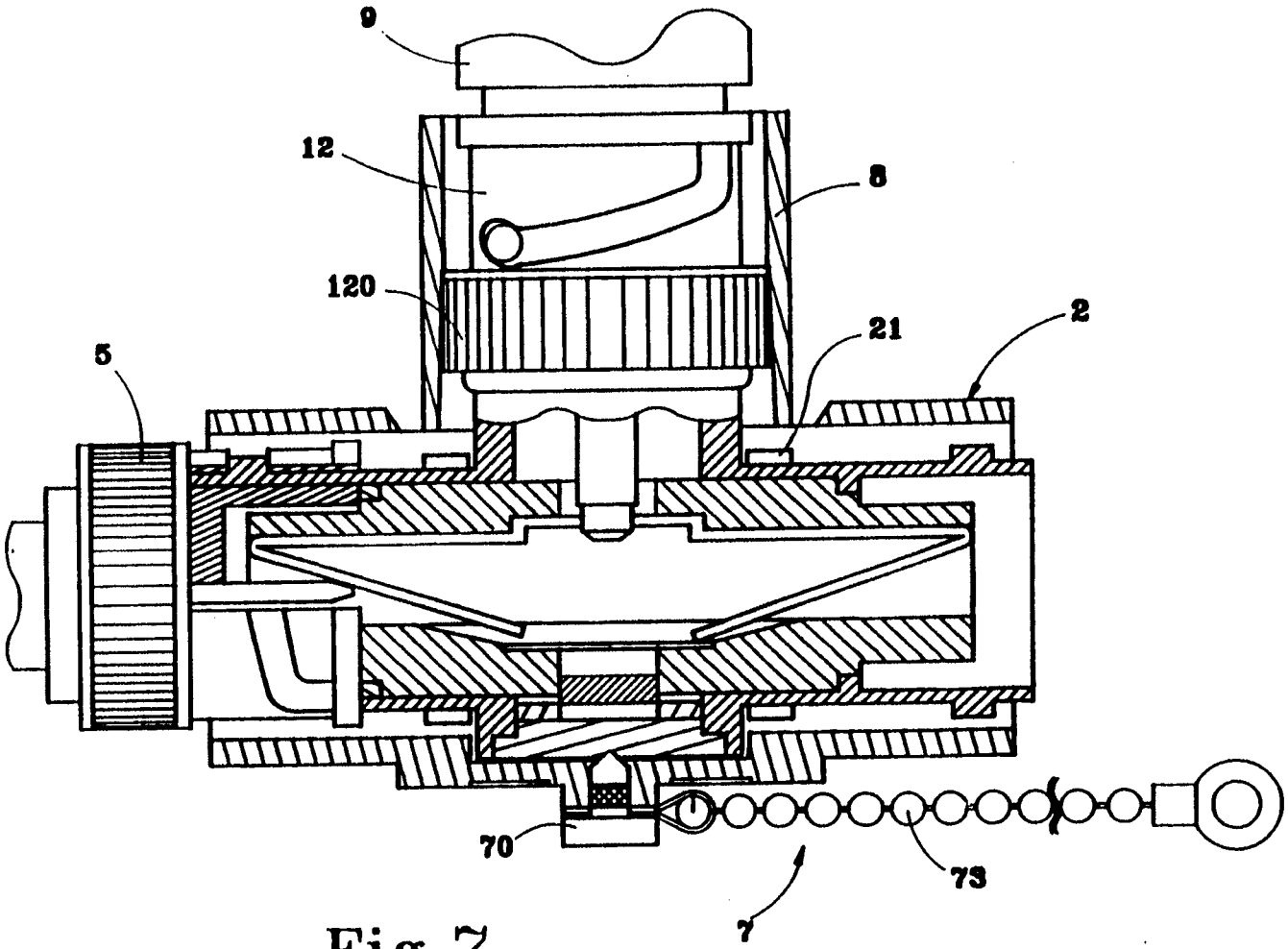
FIG. 7 is similar to FIG. 6 but showing an alternate form of the earth terminal.

Referring to FIG. 7, therein illustrated is an alternate form of the earth terminal 7. In this alternate form, a ball chain 73 is connected to the rivet 70 to replace the aforesaid tether chain. The ball chain 73 simultaneously retains the T-type BNC connector in place when the T-type BNC connector is not used.

Referring to FIGS. 6, 6A, and 7 again, the tubular insulative shield 8 is made of ABS copolymer through an injection molding process, comprised of a tubular taper body 80 made gradually bigger toward the bottom and fitted around the rotating ring 120 on the BNC plug 12. As the tubular taper body 80 of the tubular insulative shield 8 is fastened to the rotating ring 120 of the BNC plug 12, the tubular insulative shield 8 becomes tightly connected to top vertical hole 41 of the four-way shielding tube 4. When assembled, the tubular insulative shield 8 and the rotating ring 120 of the BNC plug 12 can be turned together without affecting the connection of an external BNC connector 9 to the BNC plug 12.

As indicated, the shielding device of the four-way shielding tube 4 and the insulative tubular shield 8 covers around the periphery of the T-type BNC connector to eliminate the interference of static electricity and magnetic fields, and to prevent electric shocks upon contact of the body.

I claim:

1. A shielding device for a T-type BNC connector comprised of a T-shaped shell having two BNC jacks transversely disposed in reversed directions and a BNC plug vertically disposed in the middle at the top, the shielding device comprising a four-way shielding tube covered around said T-shaped shell and said BNC jacks, and an insulative tubular shield covered around said BNC plug, said four-way shielding tube being comprised of a first insulative shield and a second insulative shield respectively made in the shape of a half-round tube and connected together through a sealing process, said four-way shielding tube comprising symmetrical ribs raised from an inside wall thereof clamped on said T-type BNC connector with an annular gap retained between said four-way shielding tube and said BNC jacks for inserting a respective external BNC connector to connect to either BNC jack, a block plate blocked on said T-shaped shell of said T-type BNC connector at the bottom, and an earth terminal inserted in a center through hole on said block plate and connected to said four-way shielding tube, said insulative tubular shield being comprised of a tubular taper body fitted around a rotating ring on said BNC plug.

2. The shielding device of claim 1 wherein said earth terminal is comprised of rivet fitted into said center through hole of said blocking plate, a tether chain connected to said rivet, and a packing ring fastened around said rivet to retain said tether chin in place.

3. The shielding device of claim 1 wherein said earth terminal is comprised of a rivet fitted into said center through hole of said blocking plate, and a ball chain connected to said rivet.

4. The shielding device of claim 1 wherein said four-way shielding tube and said insulative tubular shield are respectively made of Acrylnitrile-Butadiene-Sterene copolymer through an injection molding process.

* * * * *